United States Patent [19]

Oya

[11] 4,078,905

[45] Mar. 14, 1978

[54] EDGE-ROUNDING METHOD AND APPARATUS THEREFOR

[75] Inventor: Yoshichika Oya, Aichi, Japan

[73] Assignee: Mitsubishi Jukogyo Kabushiki Kaisha, Tokyo, Japan

[21] Appl. No.: 747,302

[22] Filed: Dec. 3, 1976

[51] Int. Cl.[2] ..... B24B 9/00; B24B 1/00

[52] U.S. Cl. ..... 51/110; 51/76 R; 51/326; 51/328

[58] Field of Search ..... 51/74 R, 76 R, 110, 51/137–139, 281 R, 326, 327, 328

[56] References Cited

U.S. PATENT DOCUMENTS

| | | | |
|---|---|---|---|
| 639,742 | 12/1899 | Koenig | 51/74 R |
| 2,617,223 | 11/1952 | McElroy | 51/76 R |
| 2,715,796 | 8/1955 | Beard | 51/110 X |
| 3,372,516 | 3/1968 | Dickinson | 51/110 |
| 3,895,464 | 7/1975 | Kiser | 51/140 X |

FOREIGN PATENT DOCUMENTS

| | | | |
|---|---|---|---|
| 1,502,511 | 2/1970 | Germany | 51/74 |

*Primary Examiner*—Harold D. Whitehead
*Assistant Examiner*—Nicholas P. Godici
*Attorney, Agent, or Firm*—Toren, McGeady and Stanger

[57] ABSTRACT

A method and an apparatus for rounding edges of workpieces by carrying the workpieces on a conveyor, rounding by a first pair of rotary buffs the edge portions of each workpiece being conveyed which are opposed to the resultant feed directions of the buffing faces of the buffs, the feeds of the buffing faces in sliding contact with the workpiece having a direction resultant of a velocity component pointing contrary to the running direction of the conveyor and a velocity component directed normal to the direction of the velocity component and toward one edge of the conveyor and also having a direction resultant of a velocity component pointing in the same direction as the running direction of the conveyor and a velocity component directed normal to the velocity component and toward the opposite edge of the conveyor, and then rounding by a second pair of rotary buffs the edge portions of the workpiece being conveyed which are opposed to the resultant feed directions of the buffing faces of the buffs, the feed directions of the buffing faces in sliding contact with the workpiece having a direction resultant of a velocity component pointing in the same direction as the running direction of the conveyor and a velocity component directed toward the one edge of the conveyor and also having a direction resultant of a velocity component pointing contrary to the running direction of the conveyor and a velocity component directed toward the opposite edge of the conveyor, whereby sharp corners and burrs on all edge portions of the workpiece can be rounded off.

2 Claims, 20 Drawing Figures

EDGE-ROUNDING METHOD AND APPARATUS THEREFOR

This invention relates to an edge-rounding method and apparatus for removing sharp corners or burrs from edges of workpieces of given shapes and rounding said edges, and more specificially to such a method and apparatus for rounding the entire edges of a workpiece in a single machining operation.

Usually the workpieces formed to desired configurations by shearing, notching, milling, rooting, grinding, fusing, chemical grinding, electrolytic (electric discharge) machining and the like have sharp corners or burrs along edges at which the planes of both sides, upper and under or front and back, and the planes of all ends or machined planes perpendicular to the both sides intersect. One example of the parts machined to desired shapes by the above-mentioned methods is perspectively shown in FIG. 1 and in an enlarged section in FIG. 2(*a*). As can be seen from the latter, edges 03, 03', 03'', and 03''', at which the upper side 01 and both ends 02, the underside 04 and the both ends 02, the upper side 01 and machined planes 05 perpendicular thereto, and the underside 05 and the machined planes 05, intersect, respectively, and have either sharp corners 06 or burrs 07 as better indicated in circles. These sharp corners and burrs must be removed by all means, beccause they tend to scratch and injure the fingers of the operator, make the clamping or fitting of the workpiece difficult, cause interference or other trouble, invite stress concentrations or hair cracks which can result in fatigue fracture of the finished part. The operation for removing the defects, or the sharp corners 06 and burrs 07, and rounding the edges as shown in FIG. 2(*b*) is known as "edge rounding." The technique is applied not only to parts of general industrial machines but also to other component parts, of the aircraft especially, for which light weight and safety are primary considerations. Because of the unusually severe service requirements all the aircraft parts must be perfectly edge-rounded without fail. The apparatus that can meet the need has been earnestly called for.

In the absence of any satisfactory apparatus devised, edge rounding has usually been done manually. The aircraft industry has, therefore, had to spend much time for this finishing work. In an attempt to save the time and labor, an edge-rounding apparatus as illustrated in FIG. 3 was proposed. The apparatus comprises a conveyor 08 for carrying workpieces A one after another, and a pair of columnar edge-rounding buffs 09, 09' arranged in tandem over and across the conveyor, the buffs being adapted to rotate in opposite directions. Each workpiece A is passed under the two buffs 09, 09' for edge-rounding while being carried by the conveyor 08. With the apparatus, as shown in FIG. 4, the sharp corners 06 and burrs 07 of edges parallel to the center axes of rotation of the buffs 09, 09' and opposed to the directions of rotation of the buffs are removed and those edges are rounded. As better shown in FIG. 5, the sharp, burred corner of the front edge of each workpiece A (the edge of the workpiece facing the direction of its travel being hereinafter called the "front" edge) is first rounded off by the buff 09. Next, the corresponding corner of the opposite edge parallel to the center axis of rotation of the other buff 09' and opposed to the direction of rotation of the same buff is rounded off by the buff 09'. That is, the rear edge (or the following end opposite to the front edge) of the workpiece A is burred and rounded. During this buffing the edges opposed to the rotating directions of the buffs 09, 09' are not adequately rounded in portions not parallel to the center axis of the buffs. The edge rounding is effected by the buffs in the form of brush wheels as shown in more detail in FIGS. 6(*a*) and 6(*b*). As shown, each edge of the workpiece parallel to the center axes of rotation of the buffs 09, 09' and opposed to the directions of rotation of the buffs is rounded as the bristles of the buffs come up from below into sliding contact with the edge and buff off the sharp corner and burr from the edge. At this time, as shown in FIG. 6(*a*), the vector B applied from each bristle of the buff 09 to the edge coincides with the vector C required for removing the corner from the edge, indicating that edge rounding is possible. However, at an edge not opposed to the rotating direction of the buff 09', the vector B of the buff 09' and the vector C necessary for rounding the edge do not coincide as shown in FIG. 6(*b*). In other words, a part or most of the forces exerted to the buff on each edge not opposed to the buffing direction is lost by slippage without acting effectively, thus making it impossible to round the edge by buffing the corner according to the angle of opposition. (Refer to FIG. 7). This will be more clearly understood from the following description of edge rounding when taken in connection with FIG. 8, in which, by way of illustration, the workpiece A is shown in the form of an annular piece having a continuous edge facing all directions. On the edge portions L, L' parallel to the center axes of rotation of the buffs 09, 09' and opposed to their rotating directions, adequate edge rounding is accomplished. On the edge portions M, M' somewhat out of parallelism, the farther from the portions L, L' the poorer the buffed conditions will be. The edge portions N at or substantially at right angles to the center axes of rotation of the buffs 09, 09' remain practically unrounded (as shown in FIG. 4). As described above, it has been merely possible with the conventional arrangement to remove sharp corners and burrs and round the edges parallel to the center axes of rotation of the buffs and opposed to the rotating directions of the buffs, leaving the edges normal to the center axes of rotation of the buffs unrounded. A common practice has, therefore, been to round the latter edges automatically after the former edges have been finished or rotate the workpiece A through 90° for buffing and rounding the unfinished edges all over again. However, rotating each workpiece exactly by 90° involves such technical difficulties that the buffed conditions are nonuniform and the edges thus rounded have to be manually finished, calling for extra labor and time. In the case of long workpieces, turning them exactly sideways is often impracticable and manual rebuffing has to be relied upon for the complete edge rounding.

The present invention aims at eliminating the aforedescribed disadvantages of the prior art edge-rounding methods and apparatuses and providing a method and apparatus whereby sharp corners and burrs on all edge portions of a front or rear, or upper or under, side of each workpiece can be rounded off in a single feeding and machining operation.

To achieve this end the invention is characterized by carrying workpieces on a conveyor, rounding the edge portions of each workpiece being conveyed which are opposed to the resultant feed directions of the buffing faces of a first pair of rotary buffs by said buffs, the feeds of the buffing faces in sliding contact with the workpiece having a direction resultant of a velocity component pointing contrary to the running direction of the conveyor and a velocity component directed normal to the direction of the velocity component and toward one edge of the conveyor and also having a direction resultant of a velocity component pointing in the same direction as the running direction of the conveyor and a velocity component directed normal to the velocity component and toward the opposite edge of the conveyor, and then rounding the edge portions of the workpiece being conveyed which are opposed to the resultant feed directions of the buffing faces of a second pair of rotary buffs by the buffs, the feed directions of the buffing faces in sliding contact with the workpiece having a direction resultant of a velocity component pointing in the same direction as the running direction of the conveyor and a velocity component directed toward the said one edge of the conveyor and also having a direction resultant of a velocity component pointing contrary to the running direction of the conveyor and a velocity component directed toward the said opposite edge of the conveyor, whereby sharp corners and burrs on all edge portions of the workpiece can be rounded off.

Also, according to the present invention, an apparatus is provided which is characterized by a conveyor for carrying workpieces thereon, a first pair of rotary buffs consisting of two parallel columnar buffs held over the conveyor, with their center axes of rotation extending horizontally above the conveyor surface and obliquely with respect to the direction in which the conveyor runs, the two columnar buffs being rotated in opposite directions, so that the first pair of rotary buffs can round the obliquely front and opposite edge portions of each workpiece being conveyed, and a second pair of rotary buffs consisting of two parallel columnar buffs also held over the conveyor, with their center axes of rotation extending horizontally above the conveyor surface and aslant at an angle of about 90° to the center axes of rotation of the said columnar buffs in the first pair, the two columnar buffs being rotated in opposite directions, so that the second pair of rotary buffs can round the edge portions contrary to the said obliquely front and opposite edge portions of the workpiece being conveyed, whereby sharp corners and burrs on all edge portions of the workpiece can be rounded off.

Further, according to the invention, an apparatus is provided which is characterized by a conveyor for carrying workpieces thereon, a first set of rotary buffs consisting of a plurality of disk-shaped buffs held over the conveyor, with their center axes of rotation extending vertically above the conveyor surface, the disk-shaped buffs consisting of plane disks of the same diameter facing the conveyor surface and covered with a buffing material for buffing in sliding contact with each workpiece, the plurality of buffs being arranged in a row across the conveyor and rotated in one and the same direction, so that the first set of rotary buffs can round the obliquely front and opposite edge portions of the workpiece being conveyed as viewed from the center axes of rotation, and a second set of rotary buffs consisting of a plurality of disk-shaped buffs similar to the buffs in the first set and held over, and arranged in a row across, the conveyor, with their center axes of rotation offset from those of the buffs in the first set by the radius of each buff widthways on the conveyor, so that the second set of rotary buffs can round the edge portions contrary to the said obliquely front and opposite edge portions of the workpiece being conveyed as viewed from the center axes of rotation, whereby sharp corners and burrs on all edge portions of the workpiece can be rounded off.

Other objects, features and advantages of the invention will become more apparent from the following description taken in connection with the accompanying drawings showing embodiments thereof. In the drawings:

FIG. 2(*b*) is a view similar to FIG. 2(*a*) but showing rounded edges;

Figure 1:
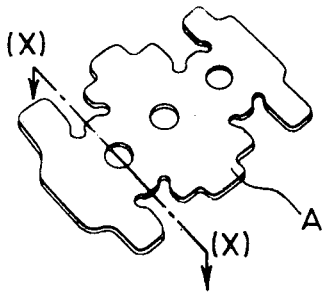
FIG. 1 is a perspective view of a workpiece formed to a desired shape by various machining operations.
Figure 2:
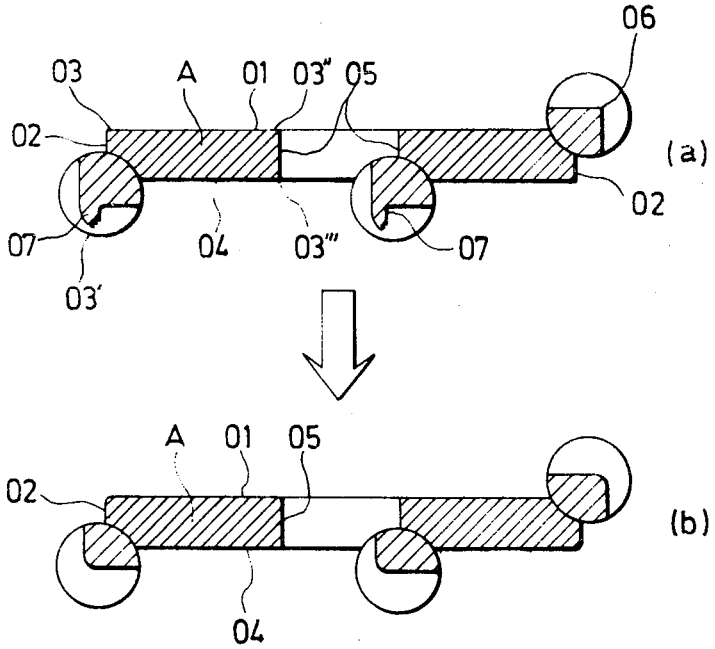
FIG. 2(*a*) is an enlarged sectional view taken along the line (X)—(X) of FIG. 1, partly shown in further details.
Figure 3:
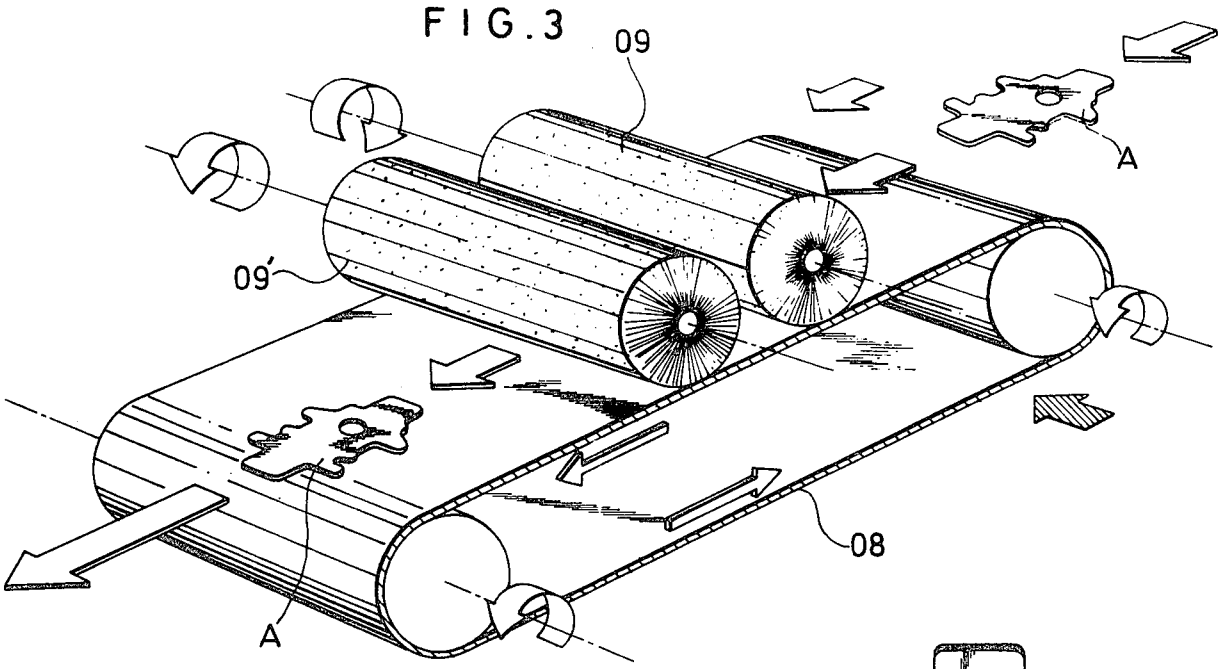
FIG. 3 is a perspective view of a conventional apparatus for edge rounding.
Figure 4:
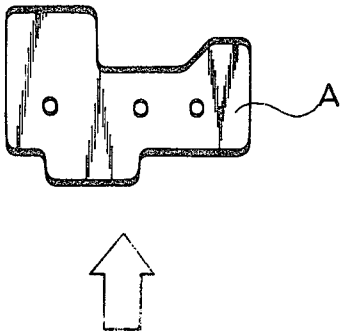
FIG. 4 is a plan view of a workpiece passed through the apparatus shown in FIG. 3 for edge rounding, the thick full lines indicating the rounded edges.
Figure 5:
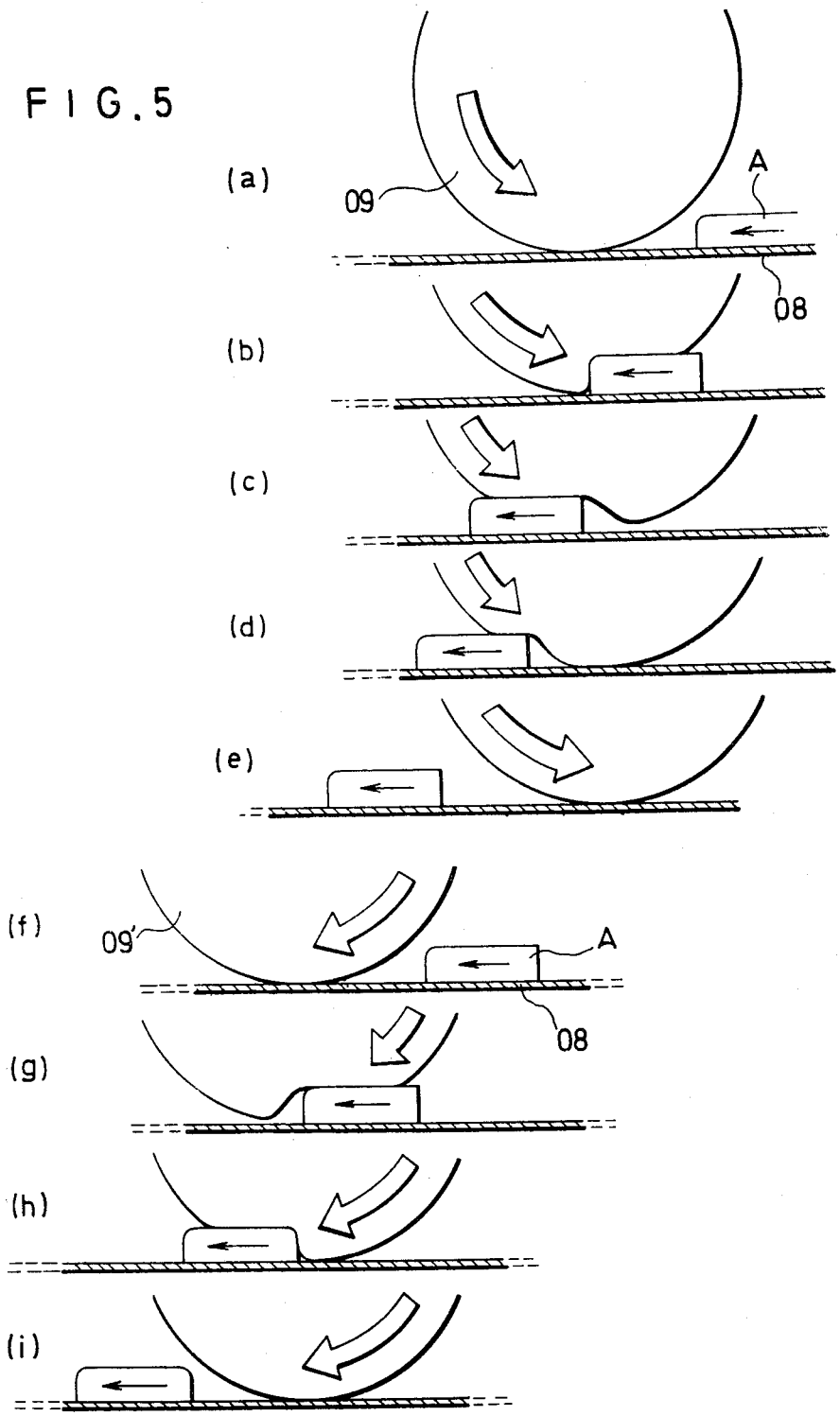
Figure 6:
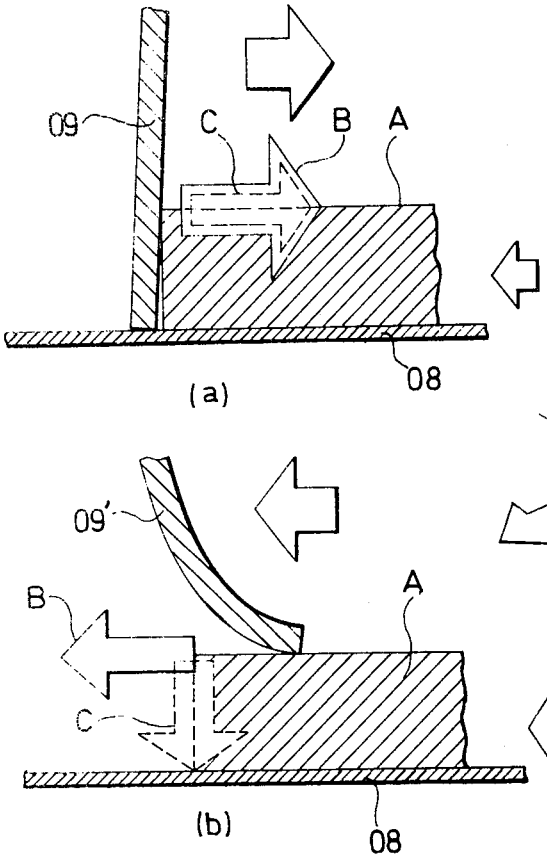
Figure 7:
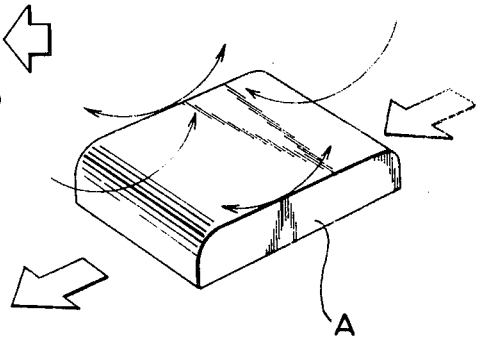
Figure 8:
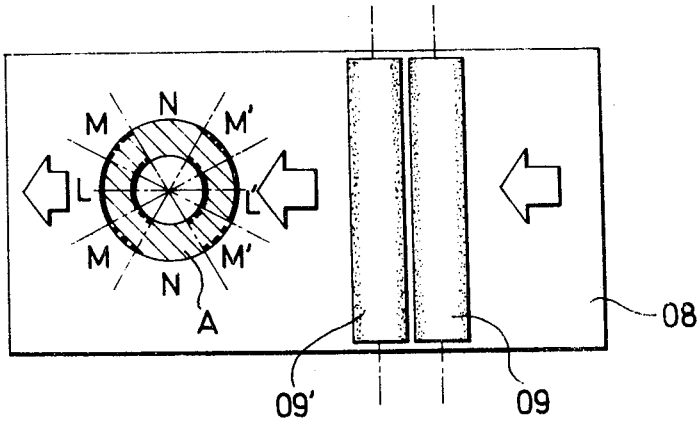
Figure 9:
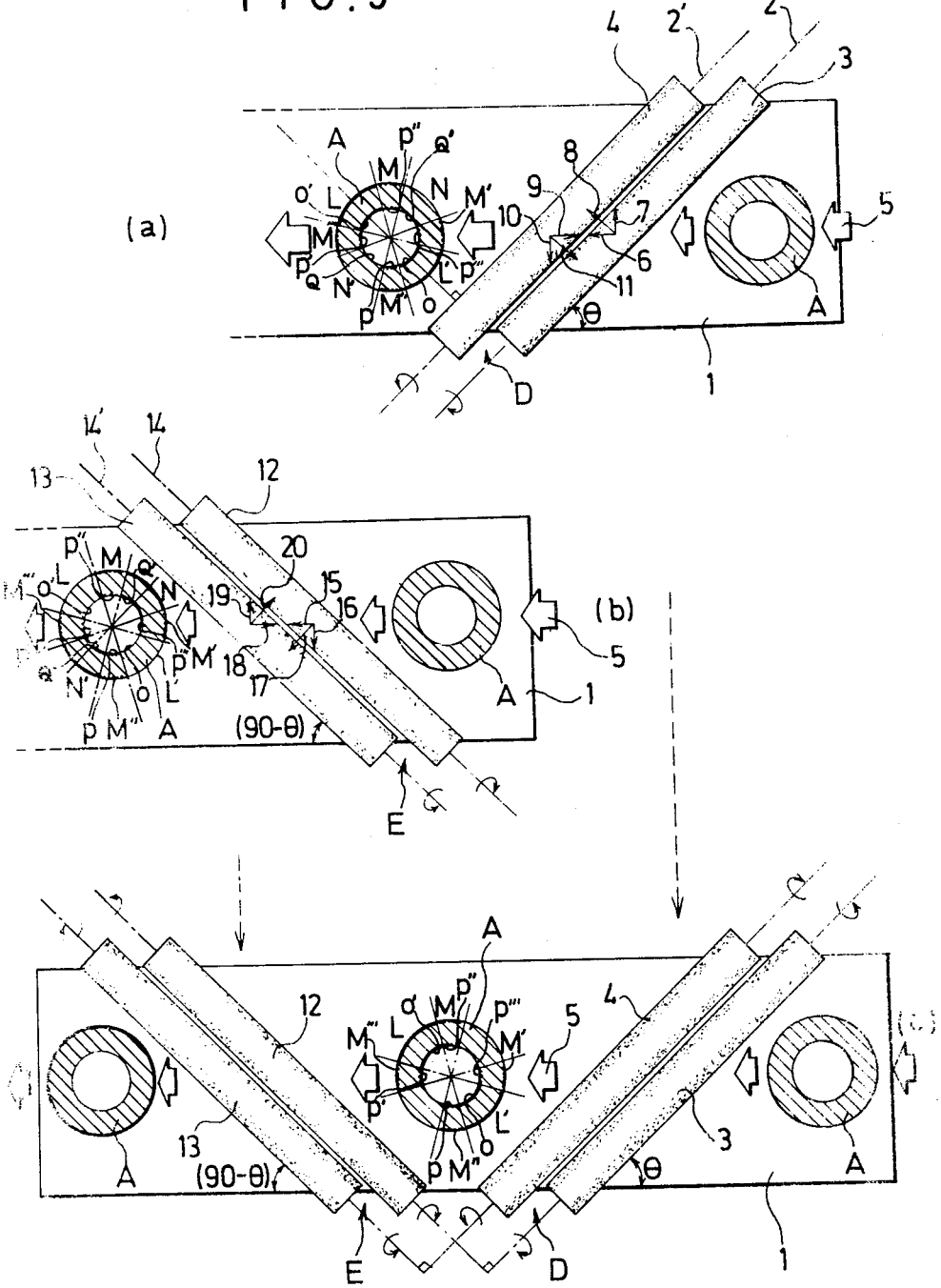
Figure 10:
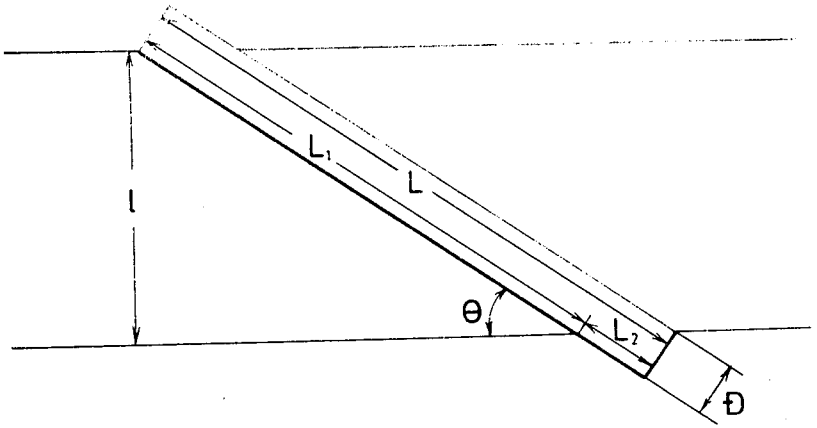
Figure 11:
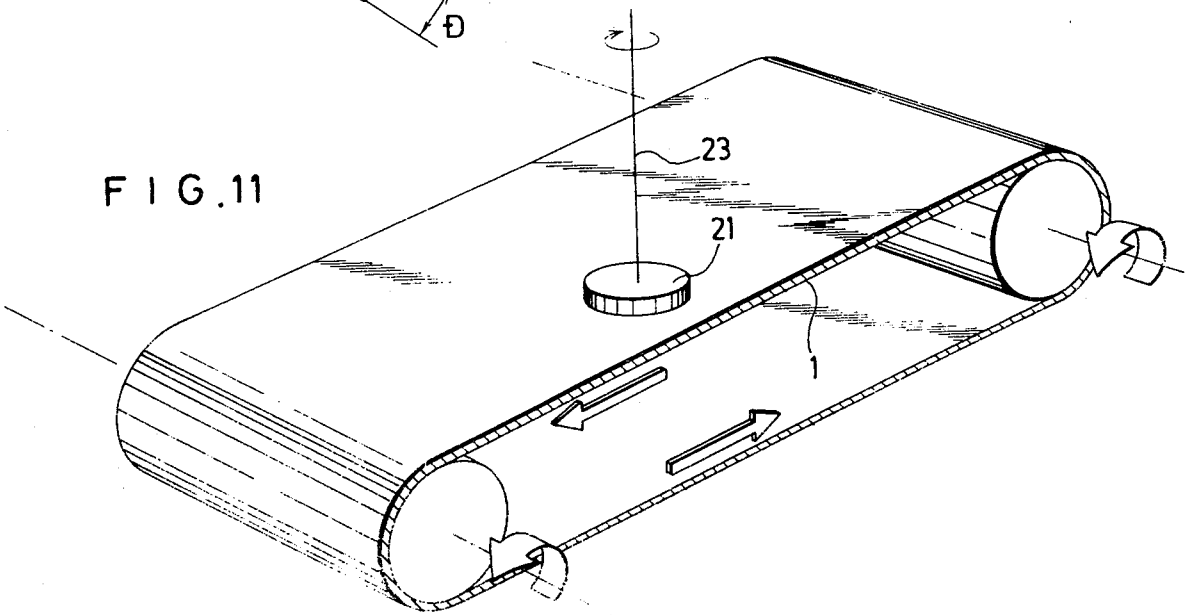
Figure 12:
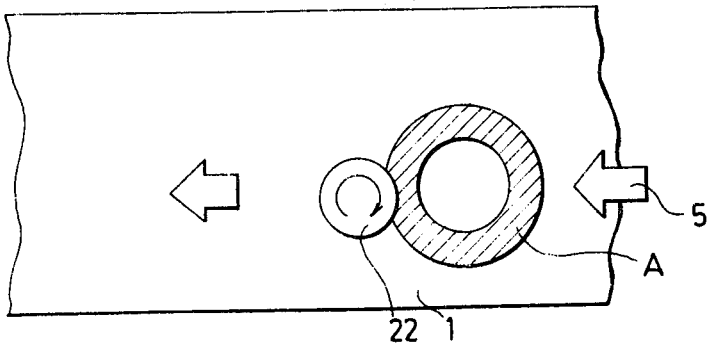
Figure 13:
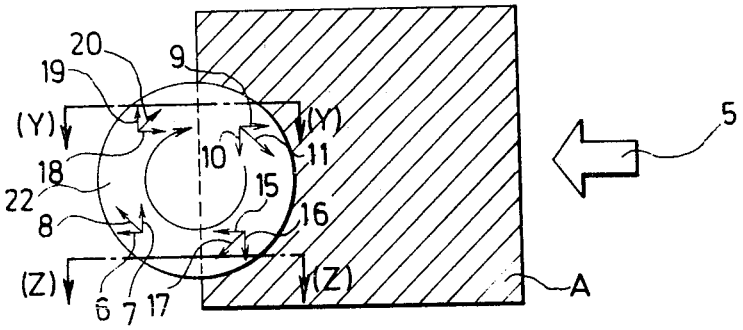
Figure 14:
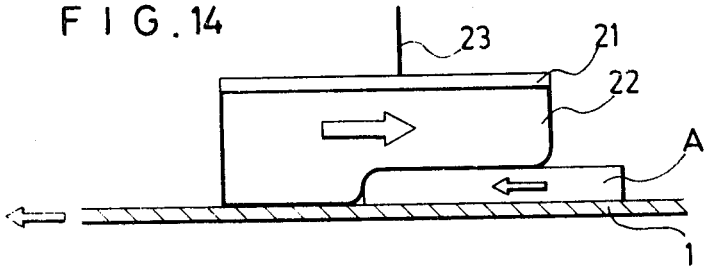
Figure 15:
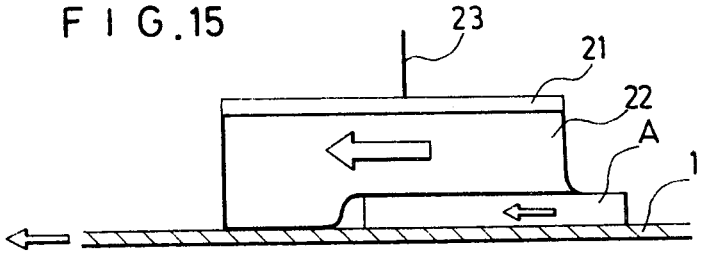
Figure 16:
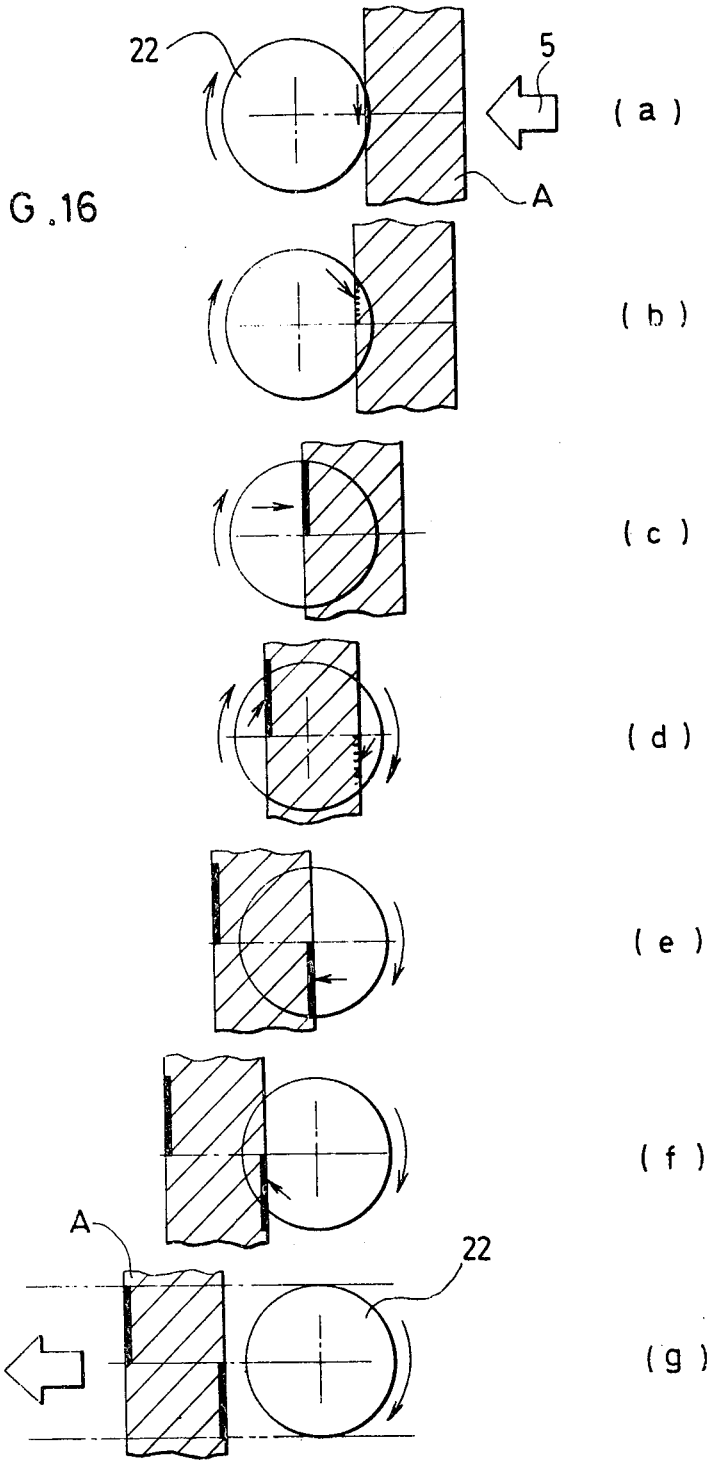
Figure 17:
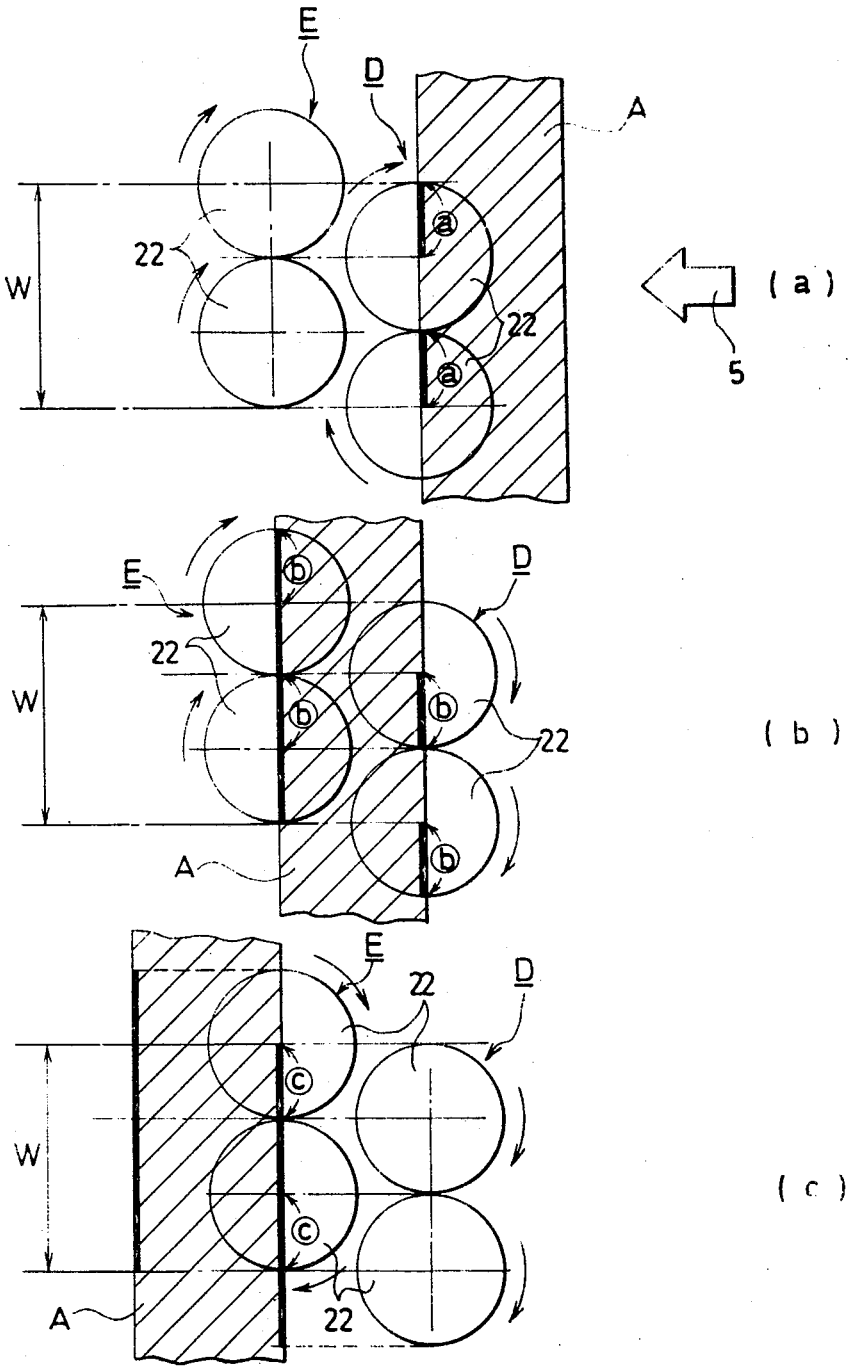
Figure 18:
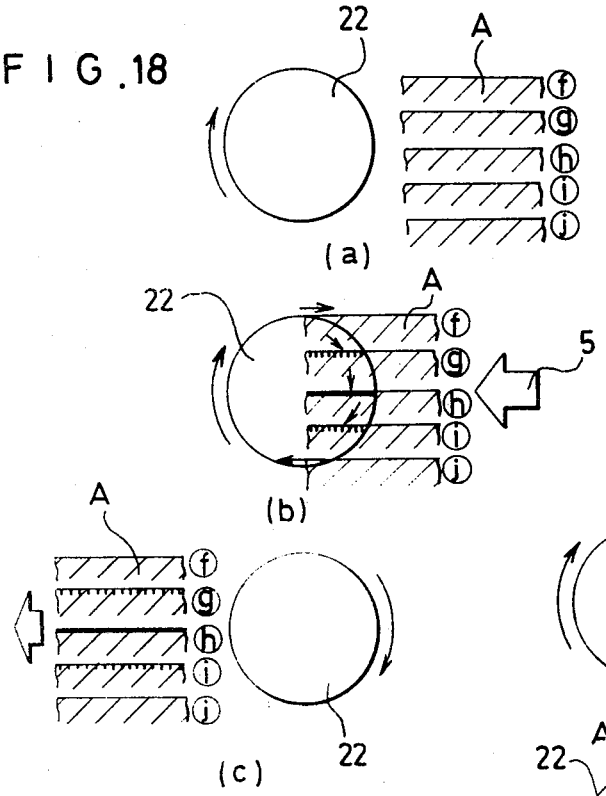
Figure 19:
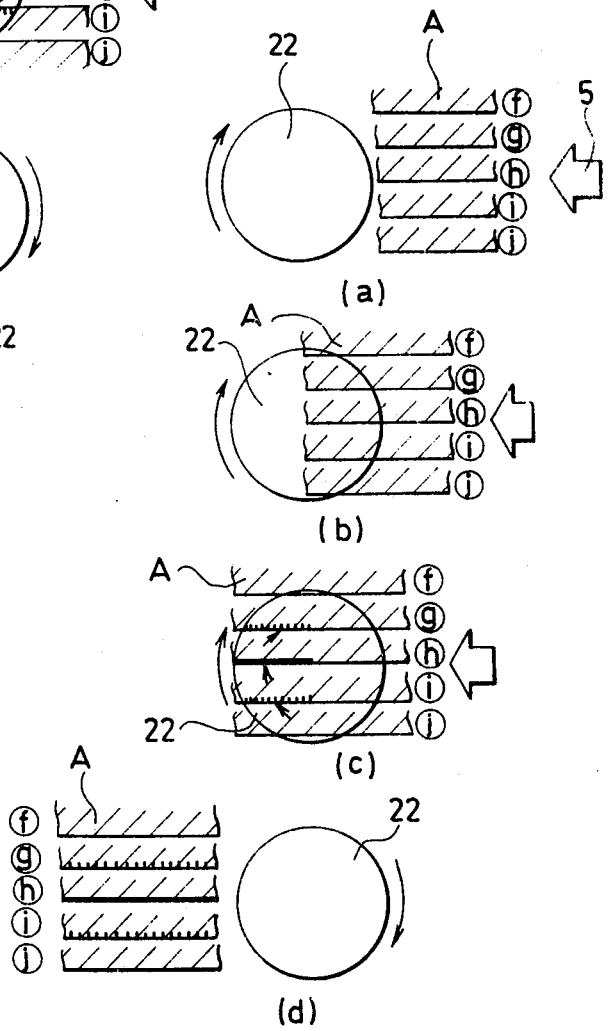
Figure 20:
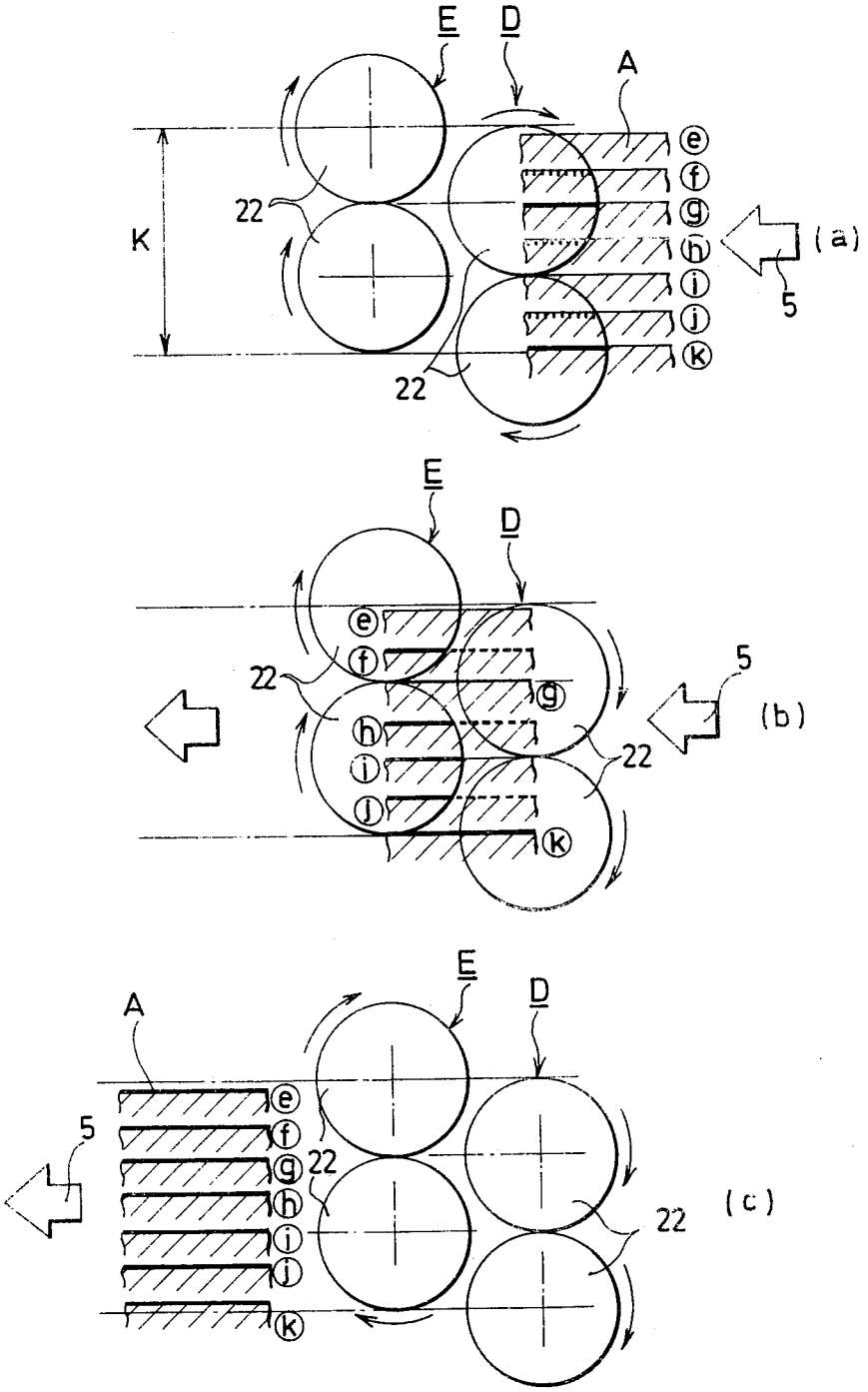

FIG. 5(*a*) through (*i*) are sequential views illustrating a cycle of edge rounding operation;

FIGS. 6(*a*) and (*b*) are side views illustrating the relationship between the feed of buffing faces and that of a workpiece;

FIG. 7 is a perspective view of a workpiece indicating the directions in which buffs are fed with respect to the workpiece on a conventional apparatus;

FIG. 8 is a plan view of a conventional apparatus and a workpiece being buffed thereon, the thick full lines indicating well-rounded edge portions and the thick broken lines medium-rounded edge portions;

FIGS. 9(*a*) to (*c*) show sequential plan views of one embodiment of edge-rounding apparatus of the invention in operation, the thick full lines indicating well-rounded edge portions and the thick broken lines medium-rounded edge portions;

FIG. 10 is a view illustrating the relation between the length and angle of a columnar buff;

FIG. 11 is a perspective view of another embodiment of the invention;

FIG. 12 is a plan view of the arrangement shown in FIG. 11;

FIG. 13 is a plan view illustrating the relation between a disk-shaped buff and a workpiece;

FIG. 14 is a vertically sectional view taken along the lline (Y)—(Y) of FIG. 13;

FIG. 15 is a similar view taken along the line (Z)—(Z) of FIG. 13;

FIGS. 16(*a*) through (*g*) are sequential views illustrating the rounding of edge portions of a workpiece at right angles to the direction of feed under a buff;

FIGS. 17(*a*) to (*c*) are sequential views illustrating the edge rounding of a workpiece by disk-shaped buffs arranged in two rows;

FIGS. 18(*a*) to (*c*) are sequential views illustrating the rounding of edges parallel to the workpiece feed direction;

FIGS. 19(*a*) to (*d*) are sequential views illustrating the rounding of edges opposite to those shown in FIGS. 18(*a*) to (*c*); and FIGS. 20(*a*) to (*c*) are sequential views illustrating the rounding of edges shown in FIGS. 18(*a*) to (*c*) by two pairs of disk-shaped buffs in two rows instead of by a single buff.

Referring now to FIGS. 9 and 10, one embodiment of the invention is shown as using columnar buffs. On a belt conveyor 1 for carrying workpieces A each having a continuous edge facing all directions, there are held a first and a second columnar buffs 3, 4 parallel to each other, with their center axes of rotation 2, 2' extending horizontally over the conveyor surface and aslant at an angle $\theta$ to the direction in which the conveyor runs. The first columnar buff 3 is adapted to rotate in the direction of the arrow (clockwise) and the second buff 4 in the opposite direction (counter-clockwise). The two buffs 3, 4 rotatable in opposite directions make a first rotary buff pair D. This means that the feed of the buffing face of the first columnar buff 3 to contact each workpiece A to be buffed has a resultant 8 of a velocity component 6 pointing in the same direction as the running direction 5 of the belt conveyor 1 and a velocity component 7 directed to one edge of the conveyor at right angles to the velocity component 6. Consequently, the edge portions L', O' and parts of the portions M', M'', P', P'' of the workpiece A opposed to the direction of the resultant feed 8 are rounded by the first columnar buff 3 in a manner as shown in FIGS. 5(*f*) to (*i*) and FIG. 6(*b*). The feed of the buffing face of the second columnar buff 4 to contact the workpiece A for buffing has a resultant 11 of a velocity component 9 pointing contrary to the direction 5 in which the conveyor 1 runs and a velocity component 10 directed to the opposite edge of the conveyor and normal to the direction of the velocity component 9. Then, the edge portions L, O and parts of the edge portions M, M''', P, P''' of the workpiece A opposed to the direction of the resultant feed 11 are rounded by the second columnar buff 4 in a manner as shown in FIGS. 5(*a*) to (*e*) and FIG. 6(*a*). To illustrate the edge-rounding operation in more detail, the edge portions L, L', O, O' substantially parallel to the center axes of rotation 2, 2' of the first and second columnar buffs 3, 4 are rounded as those sharp corners 06 of the workpiece A being conveyed in the direction 5 (identical with the running direction of the conveyor) collide with the buffing faces, with the resultant feeds 8, 11 directed opposite to each other, so that the buffing faces are forced upward from below into sliding contact with those edge portions. Therefore, the vectors B of the buffs 3, 4 being applied to the edge portions L, L', O, O' coincide with the vectors C required for rounding those edge portions as shown in FIG. 6(*a*), permitting removal of the sharp corners 06 and burrs 07 from the edge portions L, L' and O, O'. In the meantime, the edge portions N, N', Q, Q', which are not opposed to the resultant feeds 8, 11 of the buffs 3, 4 but at right angles to the center axes of rotation 2, 2' of those buffs, are not in the least rounded because the resultant feeds 8, 11 of the buffs 3, 4 are tangential to the edge portions N, N', Q, Q' and their vectors C necessary for edge rounding are not aligned to, but are normal to, the vectors B of the buffing faces of those buffs. The edge portions M, M', M'', M''' and P, P', P'', P''' between the edge portions L, L', O, O' and N, N', Q, Q', respectively, i.e., the portions neither parallel to nor normal to the center axes of rotation 2, 2' of the buffs 3, 4, are only partly buffed since the farther those intermediate portions are away from the portions L, L', O, O', the more obliquely the buffing faces will slide along those intermediate portions, with increasing slippage between the buffing faces and the edge portions and less forces applicable, and the vectors B and C will no longer coincide. For this reason, the closer the edge portions are to the portions N, N', Q, Q', the more difficult the edge rounding will be. [Refer to FIG. 9 (*a*).] As can be seen from FIG. 9(*a*), the workpiece A buffed by the first rotary buff pair D is best rounded at the edge portions L, L', O, O' parallel to the center axes of rotation 2, 2' of the first buff pair D, whereas the edge portions N, N', Q, Q' at right angles to those center axes of rotation are least rounded. The edge portions M, M', M'', M''' and P, P', P'', P''' between the portions L, L', O, O' and N, N', Q, Q', respectively, are less and less completely rounded as they approach the edge portions N, N', Q, Q'. In order that the edge portions N, N', Q, Q', M, M', M'', M''', P, P', P'', P''' of the workpiece A be all rounded uniformly, a third columnar buff 12 and a fourth columnar buff 13 are held over the conveyor 1, at right angles to the first and second columnar buffs 3, 4, respectively, of the first buff pair D. The third and fourth columnar buffs 12, 13, are installed in parallel, with their center axes of rotation 14, 14' extended horizontally over the surface of the conveyor 1 and aslant at an angle $(90 - \theta)$ to the direction 5 in which the conveyor runs. The third columnar buff 12 is adapted to rotate in the direction of the arrow (clockwise) and the fourth columnar buff 13 in the opposite direction (counterclockwise), and these buffs rotatable in opposite directions are combined to form a second rotary buff pair E. This means that the feed of the buffing face of the third columnar buff 12 to contact each workpiece A to be buffed has a resultant 17 of a velocity component 15 pointing in the same direction as the running direction 5 of the belt conveyor 1 and a velocity component 16 directed at right angles to the component 15 and toward one edge of the conveyor reverse to the velocity component 7 widthwise of the first columnar buff 3. It is by this third columnar buff 12 that the edge portions N, Q and parts of the edge portions M, M', P, P' opposed to the resultant feed 17 are rounded in a manner as illustrated in FIGS. 5(*f*) through (*i*) and FIG. 6(*a*). Similarly, the feed of the buffing face of the fourth columnar buff 13 to contact the workpiece A for buffing has a resultant 20 of a velocity component 18 pointing contrary to the direction 5 in which the conveyor 1 runs and a velocity component 19 directed at right angles to the component 18 and toward one edge of the conveyor reverse to the velocity component 16 widthwise of the third columnar buff 12. Then, the edge portions N', Q' and parts of the edge portions M'', M''', P'', P''' opposed to the direction of the resultant feed 20 are rounded by the fourth columnar buff 13 in a manner as shown in FIGS. 5(*a*) through (*e*) and FIG. 6(*a*). [Refer also to FIG. 9(*b*).] As described above, this embodiment of the invention comprises a first rotary buff pair D consisting of a first and a second columnar buffs 3, 4 and a secondary rotary buff pair E consisting of a third and a fourth columnar buffs 12, 13, both of the pairs being installed over a belt conveyor 1 so that edge portions L, L', O, O' of the workpiece A are well rounded and edge portions M, M', M'', M''', P, P', P'', P''' are rounded to medium degrees by the first rotary buff pair D, and edge portions N, N', Q, Q' are well rounded and the edge portions M, M', M'', M''', P, P', P'', P''' are again rounded to medium degrees by the second rotary buff pair E, whereby the edge portions difficult to be rounded are repeatedly buffed and the entire edge portions are perfectly and uniformly rounded.

In this embodiment of the invention, the directions in which the first to fourth columnar buffs 3, 4, 12 and 13 rotate are not limited to those specified above, but may be otherwise as long as the buffs in each pair run in opposite directions. When the first and third columnar buffs 3, 12 are rotated clockwise and the second and fourth columnar buffs 4, 13 are rotated counterclockwise as in the present embodiment, the workpiece A is pressed downward at the front and rear ends and is thereby kept from floating upward during the buffing operation for edge rounding. The first rotary buff pair D is installed aslant on the belt conveyor 1 at an angle $\theta$ to the longitudinal axis of the conveyor. The angle $\theta$, which is usually 45°, permits reduction in size of the apparatus. The length L of each columnar buff is, as shown in FIG. 10, $$L = L_1 + L_2 = \frac{1}{\sin\theta} + \frac{D}{\tan\theta}$$

where $l$ is the width of the conveyor, and $D$ is the diameter of the buff, and the smaller the $\theta$, the greater the buff length and the larger the apparatus will become. Although the first rotary buff pair D is installed at an angle of 90° to the second pair E, the two pairs may be held apart at a slightly greater or smaller angle if the machining tolerance is not critical. As regards the relationship between the peripheral velocity of the buff and the feed velocity of the belt conveyor, it may be stated that, when $$V_B < V_c$$

where $V_B$ is the feed velocity of the belt conveyor, and $V_C$ is the peripheral velocity of the buff, the workpiece will be rounded at edge portions facing and reverse to the direction in which the conveyor runs, as on a conventional apparatus, and when $$V_B > V_C$$

the workpiece will be buffed for edge rounding as shown in FIGS. 9(*a*) to (*c*). Usually in this case $$V_B > 1000\ V_C$$

and even in unusual cases the values are understood to fall within the range $$V_B > 100\ V_C$$

and hence the workpiece can always be edge-rounded as shown in FIGS. 9(*a*) to (*c*).

The present invention will be further described below with reference to FIGS. 11 through 20 illustrating another embodiment thereof. If, as shown in FIG. 11, a disk 21 held over the belt conveyor 1 is rotated, there will be four resultant feeds 8, 11, 17 and 20 of the buffing face in the rotation of the single disk as indicated in FIG. 13. With this in view, the embodiment contemplates the rounding of the entire edge portions of a workpiece by means of a disk-shaped buff 22 that replaces the disk 21. Of the resultant feeds 8, 11, 17 and 20, the feeds which actually take part in the edge rounding of the work are those applicable where the direction of feed is opposed to the feed of the workpiece A. Because only two out of the four resultant feeds apply when a single disk-shaped buff is used for edge rounding, a plurality of such buffs will be employed in two rows. The operation of the arrangement will now be explained as a sequence with reference to the drawings.

FIG. 12 is a plan view of the conveyor 1 shown in FIG. 11. The workpiece A is conveyed from right to left as shown. The buff 22 is fixed in position and its shaft 23 is not movable out of place. The shaft 23 rotates clockwise as viewed from the top. In the following description the shaft is understood to rotate only clockwise by way of simplification; if it is rotated contrariwise the edge rounding will be accomplished reversely but otherwise exactly the same principle will apply. In FIG. 12 the workpiece A is shown as an annular, doughnut-shaped part having edge portions in all directions, and also it will be appreciated that in such a case a single buff does not cover the entire area of the conveyor. The buff 22 is frequently smaller than the workpiece A to be encountered. Thus, the arrangement shown in FIG. 12 does not provide an adequate example for describing the present embodiment with respect to the directionality of work edges, and therefore the arrangement shown in FIG. 13 is referred to instead in the following description. The figure shows how the buffing face of the disk-shaped buff is related to the front edge of a workpiece A that is conveyed past the underside of the buff and also how the edge is rounded thereby. If in this arrangement the buff is so built as to round evenly all edges of a workpiece, of whatever direction, that will come under the buff, then a plurality of the buffs, held over the entire width of the conveyor 1, will be able to uniformly round all edges in all directions of all workpieces carried by the conveyor within its width.

Referring to FIG. 13, the rounding of the edge of the workpiece A at right angles to the direction in which it is conveyed will now be considered. Depending on the difference in edge-rounding condition, the disk-shaped buff 22 shown will be discussed below as divided into two, or upper and lower halves. First, the manner in which the work edge under the upper half of the buff 22 can be seen from a section through the line (Y)—(Y) of FIG. 13, i.e., from FIG. 14. The buffing face of the buff 22 turns against the edge of the workpiece A from below and slides over the work surface, rounding off the corner as shown. In FIG. 15, which is a vertical section through the line (Z)—(Z) of FIG. 13 showing the lower half of the disk-shaped buff 22, the relationship between the buff and the edge is contrary to that shown in FIG. 14. The buffing face that has come to the edge continues to slide forward a short distance escapingly away from the edge, leaving the edge practically unrounded. (The relation between the edge and the running direction of the buff for edge rounding is the same as in the preceding embodiment already explained.) The edge-rounding conditions in FIGS. 13 to 15 may be otherwise represented sequentially, including intermediate steps with the advance of the conveyor, as in FIGS. 16(*a*) through (*g*). First, in (*a*), the rotating direction of the buff is parallel to the edge of the approaching workpiece, and therefore the edge is little rounded. In (*b*) the buff is partly and obliquely in sliding contact with the workpiece, and the upper half of the edge under the buff is rounded to a medium degree, whereas the lower half of the edge remains virtually unrounded because the same relationship as in FIG. 15 holds. In (*c*) the upper half of the work edge under the buff is completely rounded. As the workpiece proceeds to (*d*), its rear edge begins to be buffed (with the lower half of the edge being subjected to the upward buffing and rounding action), and, in (*e*), the lower half is completely rounded. Finally, the workpiece leaves the buff in the state shown in (*g*). Here it will be appreciated that the part leaving the buff as in FIG. 16(*g*) is not completely rounded at both edges. With the single disk-shaped buff 22 rotating horizontally, the edges of the workpiece extending at right angles to the direction in which the work is fed can be rounded only at the portions equivalent to the upper half of the front edge and the lower half of the rear edge as viewed in a circle centered on the center of rotation of the disk-shaped buff 22, or within the area covered by the buff. In order to make up for this incompleteness, a plurality of the buffs 22 are used, according to the invention in an assembly now to be described. The buffs are arranged staggerdly, for example, in two rows, the buffs in one row being offset from those in the other row by the radius of each buff. This means that each work edge can be rounded continuously instead of being buffed only at the edge portion equivalent to the radius of one buff. With this arrangement in which the buff rows are offset by the radius of the buff, it is important that all buffs be rotatable in one and the same direction, for otherwise the edge-rounding positions of the individual buffs may be changed (or reversed) undesirably.

The staggered arrangement is illustrated in FIGS. 17(*a*) to (*c*). If the width of edge portions of a workpiece to be edge-rounded is W, the buffs 22 are arranged within W in two rows offset by the radius of the buff. (Although the buffs are shown staggeredly in two rows, they may be disposed otherwise provided they are offset by the radius and rotated in the same direction.) In FIG. 17(*a*), the edge portions ⓐ are rounded, in (*b*) the portions ⓑ are rounded, and in (*c*) the remaining portions ⓒ are rounded. In the end the sharp corners of the front and rear edges of the workpiece A within W for edge rounding are evenly rounded off.

Next, edge rounding of a workpiece A having edges parallel to the running direction 5 of the conveyor 1 (i.e., the direction in which the workpiece is conveyed) will be discussed. The extent of edge rounding varies with the location of the buff 22 under which the work edge to be rounded passes. This is schematically illustrated in FIGS. 18(*a*) to (*c*). There is shown a workpiece A having an edge parallel to the conveying direction 5 and being conveyed under a buff 22, as if taking five different courses to indicate the variation of the degree of edge rounding to be accomplished with the position of the buff with respect to the incoming edge. In the course ⓕ or ⓙ the edge is little rounded because it is substantially parallel to the rotating direction of the buff 22. In the course ⓗ the buff runs counter to the edge, buffing it upward and accomplishing good rounding. In the course ⓖ or ⓘ the buff 22 runs obliquely over the edge, resulting in a medium degree of rounding. Eventually, as shown in FIG. 18(*c*), the work edge that has passed the center of the buff is well rounded, but the closer the course is to the periphery of the buff the less the removal of the sharp corner or burr from the edge will be.

For the same reason, the edge opposite to any of those taking the courses ⓕ to ⓙ is rounded by the left half of the disk-shaped buff 22 as shown in FIGS. 19(*a*) to (*d*), finally leaving the buff in the state shown in FIG. 19(*d*). In FIG. 19(*b*) the buff 22 rotates in the direction to slip away escapingly from the edge in whatever course, and the edge is left unrounded. In FIG. 19(*c*) the edge comes to a position where it is subjected to the buffing and rounding action and, by the exact reverse of what happened in FIG. 18(*b*), the edge is rounded to a varying degree and leaves the buff in the state shown in FIG. 19(*d*). In either case the edge parallel to the running direction of the conveyor 1 is completely rounded only when it passes under the central portion of the buff 22. Otherwise, the farther the edge is away from the center of the buff, the lesser the extent to which the edge will be rounded, as indicated in FIGS. 18(*c*) and 19(*d*) alike.

This problem can be solved by arranging a plurality of buffs 22 in two rows, for example, with each buff in one row offset from the adjacent buff in the other row by the radius of its own, as in FIGS. 20(*a*) to (*c*). The buffs, adapted to rotate in one and the same direction, are shown staggered by the radius of each buff, in the same manner as in FIG. 17(*a*), over a width equivalent to an effective width K of a workpiece to be edge-rounded. In order to show how the edge of a workpiece A is rounded in different ways, it is presumed that the work edge takes different courses ⓔ to ⓚ as in FIG. 18(*a*). The edge in the course ⓔ or ⓘ in FIG. 20(*a*) is little rounded as it passes along the periphery of one of the buffs 22, but it then passes under the next buff, near its center, and is completely rounded as shown in FIG. 20(*b*).

When taking the course ⓕ ⓗ or ⓙ in FIG. 20(*a*), the edge is rounded to a medium extent as it passes under the portion midway between the periphery and center of one of the buffs 22. In FIG. 20(*b*), the same edge again passes under the midway portion of the next buff for medium buffing. Thus, after the passage under the two buffs, the edge is completely rounded. In the course ⓖ or ⓚ the edge passes under the center or central portion of one of the buffs and is completely rounded as shown in FIG. 20(*a*). The same edge in FIG. 20(*b*) passes along the periphery of the next buff and is practically not rounded any more. As described above, this arrangement of buffs staggered by the radius of each buff permits the work edge to be rounded completely and uniformly in whatever course the workpiece may proceed, provided the edge is parallel to the direction in which the workpiece is conveyed.

Exactly the same applies to the opposite edge of the workpiece, and the buff arrangement described above permits complete and uniform rounding of the edge in the same way as above (and therefore the detailed explanation is omitted). For any edge of the workpiece A neither normal to nor parallel to the direction in which the workpiece is conveyed, or for any work edge at an angle to the conveying direction, the conditions are not as severe as with the right-angled or parallel edges. The buffing and rounding actions which would be exerted to the right-angled and parallel edges are combined according to the angle of the particular edge, and the resultant acts on the edge to round the same uniformly.

In accordance with the present invention, a plurality of columnar or disk-shaped buffs are arranged in such a manner that two pairs or sets of such rotary buffs have buffing faces to be fed by opposite resultants, each of two different directions, i.e., the running direction of the conveyor and the direction widthways of the conveyor. The apparatus can therefore round off sharp corners and burrs on all edge portions of a workpiece by a single buffing operation on the conveyor.

What is claimed is:

1. A method for rounding edges of workpieces which comprises carrying the workpieces on a conveyor, rounding by a first pair of rotary buffs the edge portions of each said workpiece being conveyed which are opposed to the resultant feed directions of the buffing faces of the buffs, the feeds of said buffing faces in sliding contact with said workpiece having a direction resultant of a velocity component pointing contrary to the running direction of said conveyor and a velocity component directed normal to the direction of said velocity component and toward one edge of said conveyor and also having a direction resultant of a velocity component pointing in the same direction as the running direction of said conveyor and a velocity component directed normal to said velocity component and toward the opposite by a second pair of rotary buffs the edge portions of said workpiece being conveyed which are opposed to the resultant feed directions of the buffing faces of the buffs, the feed directions of said buffing faces in sliding contact with said workpiece having a direction resultant of a velocity component pointing in the same direction as the running direction of said conveyor and a velocity component directed toward said one edge of said conveyor and also having a direction resultant of a velocity component pointing contrary to the running direction of said conveyor and a velocity component directed toward said opposite edge of said conveyor, whereby sharp corners and burrs on all edge portions of said workpiece can be rounded off.

2. An apparatus for rounding edges of workpieces which comprises a conveyor having a support surface for carrying the workpieces thereon, the first set of rotary buffs consisting of a plurality of disk-shaped buffs of the same diameter held over the conveyor, with the center axes of rotation of said buffs extending vertically above the conveyor support surface, and each said buffs having a buffing surface facing downwardly toward the conveyor support surface for buffing the workpieces while being in sliding contact therewih, said plurality of buffs being arranged in a row across said conveyor and extending transversely of the direction of travel of said conveyor and rotated in one and the same direction, so that said first set of rotary buffs can round the obliquely disposed front and opposite edge portions of said workpiece being conveyed on said conveyor as viewed from the center axes of rotation, and a second set of rotary buffs consisting of a plurality of disk-shaped buffs spaced from said first set in the direction of travel of said conveyor and being of the same diameter which is the same as the diameter of said buffs in said first set and held over said conveyor in a row across said conveyor transversely of the direction of travel thereof, with the center axes of rotation of said buffs in said second set extending vertically above the conveyor surface and each said buff in said second set having a buffing surface facing downwardly toward the conveyor support surface for buffing the workpieces while in sliding contact therewith, the center axes of rotation of said disks in said second set being offset from the center axes of rotation of said buffs in said first set by an amount equal to the radius of each said buff and said buffs in said second set being rotated in the same direction and in the same direction as said buffs in said first set, said buffs in said first set having the circumferential peripheral edges thereof disposed in adjoining relationship and said buffs in said second set having the circumferential peripheral edges thereof disposed in adjoining relationship so that said buffs in each of said first and second sets form a continuous buffing surface transversely across said conveyor, so that said second set of rotary buffs can round the edge portions contrary to said obliquely front and opposite edge portions of said workpiece being conveyed as viewed from said center axes of rotation, whereby sharp corners and burrs on all edge portions of said workpiece can be rounded off.

* * * * *